United States Patent [19]

Onodera et al.

[11] Patent Number: 4,961,376

[45] Date of Patent: Oct. 9, 1990

[54] PRINTER

[75] Inventors: Kenji Onodera; Masami Ohkawa, both of Suwa, Japan

[73] Assignee: Seiko Epson Corporation, Tokyo, Japan

[21] Appl. No.: 488,408

[22] Filed: Mar. 1, 1990

Related U.S. Application Data

[63] Continuation of Ser. No. 57,088, Jun. 2, 1987, abandoned.

[30] Foreign Application Priority Data

| | | | |
|---|---|---|---|
| Jun. 3, 1986 | [JP] | Japan | 61-128963 |
| Jun. 4, 1986 | [JP] | Japan | 61-129779 |
| Jun. 4, 1986 | [JP] | Japan | 61-129780 |
| Jun. 4, 1986 | [JP] | Japan | 61-129781 |

[51] Int. Cl.[5] ..... B41J 1/20

[52] U.S. Cl. ..... 101/93.14; 400/146

[58] Field of Search ..... 400/124, 146; 101/93.14, 93.31, 93.23

[56] References Cited

U.S. PATENT DOCUMENTS

| | | | |
|---|---|---|---|
| 3,286,625 | 11/1966 | Petit | 101/93.23 |
| 3,795,187 | 3/1974 | Babler | 101/93.14 |
| 3,848,527 | 11/1974 | Nihira | 101/93.23 |
| 3,884,338 | 5/1975 | Koller | 400/146 |
| 3,915,276 | 10/1975 | Metz | 400/124 |
| 4,297,944 | 11/1981 | Nihira | 101/93.31 |
| 4,455,936 | 6/1984 | Hovi | 101/93.14 |
| 4,475,828 | 10/1984 | Nishikawa | 400/146 |

FOREIGN PATENT DOCUMENTS

| | | | |
|---|---|---|---|
| 2836396 | 2/1980 | Fed. Rep. of Germany | 400/146 |
| 209142 | 11/1984 | Japan | 400/146 |

*Primary Examiner*—Edgar S. Burr
*Assistant Examiner*—Joseph R. Keating
*Attorney, Agent, or Firm*—Blum Kaplan

[57] ABSTRACT

A printer for printing on a print medium. A type carrier is in the form of an endless belt having a plurality of type elements on a side face. A hammer mechanism urges the type elements in the print medium into contact. The hammer mechanism extends substantially parallel to a portion of the type carrier and includes a hammer member for each printable position of the printer. A print drum mechanism selectively drives the hammer mechanism. The print drum mechanism includes the print drum with a plurality of projections around the peripheral surface of the print drum. There are a like number of projections and hammer members. Each of the projections is adapted to drive a separate hammer member and rotation of the print drum results in the driving of the hammer members by the projections. A control mechanism coupled to the type carrier and the print drum mechanism selectively advances the endless belt relative to the hammer mechanism and rotates the print drum. As a result, selective printing of the type elements onto the printing medium is performed.

25 Claims, 17 Drawing Sheets

FIG. 3
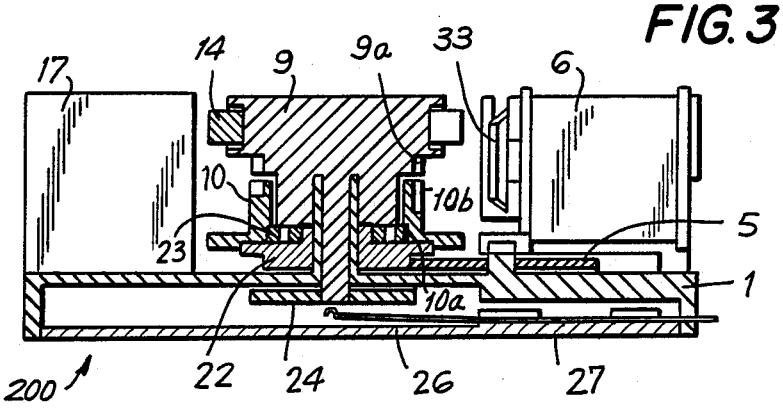
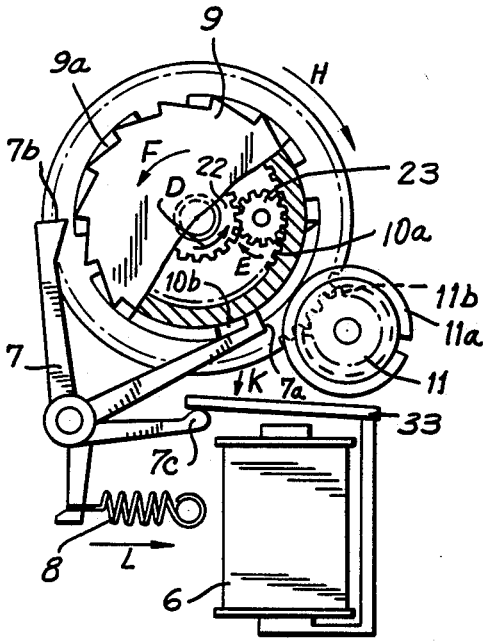
FIG. 6A
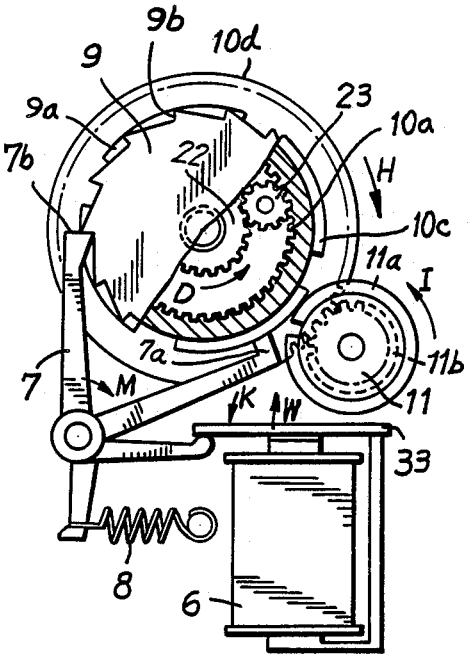
FIG. 6B

FIG. 10
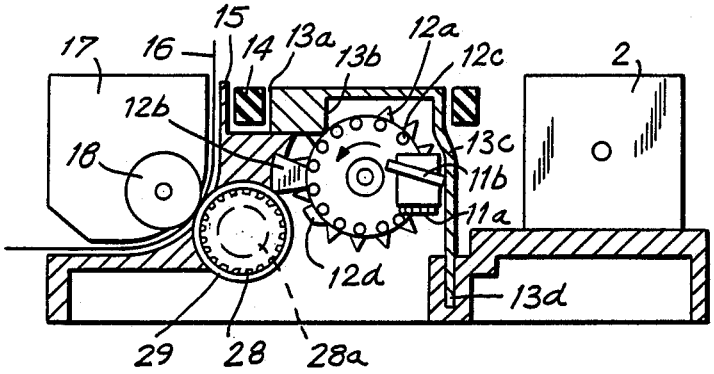
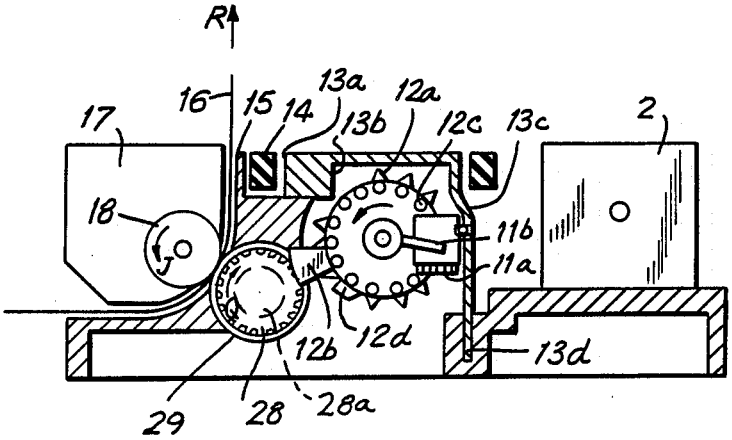
FIG. 11

FIG. 13
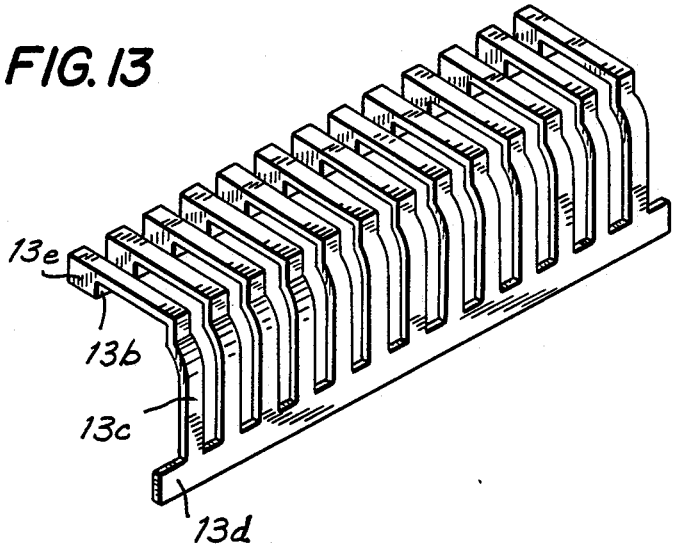
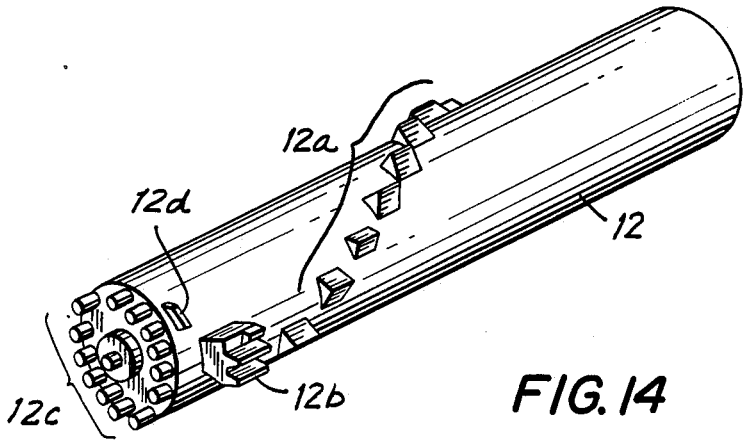
FIG. 14

FIG. 16

␣ : SPACE

| TYPE POSITION | GROUP I | | | | | | | | | | | | | | | | | | | | | | | | | | | | | | | | GROUP II | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 60 | 61 | 62 | 63 |
| TYPE A | ␣ | ␣ | ␣ | ␣ | ␣ | ␣ | ␣ | ␣ | ␣ | ␣ | ␣ | % | * | ◇ | + | − | × | ÷ | M | = | ° | # | 0 | 1 | 2 | 3 | 4 | 5 | 6 | 7 | 8 | 9 | ␣ | ␣ | ␣ | ␣ | ␣ | ␣ | ␣ | ␣ | ␣ | ␣ | % | * | ◇ | + | − | × | ÷ | M | = | ° | # | 0 | 1 | 2 | 3 | 4 | 5 | 6 | 7 | 8 | 9 |
| TYPE B | ␣ | % | ␣ | * | ␣ | ◇ | ␣ | + | ␣ | − | ␣ | * | ␣ | ÷ | ␣ | M | ␣ | = | ␣ | ° | ␣ | # | 0 | 1 | 2 | 3 | 4 | 5 | 6 | 7 | 8 | 9 | ␣ | % | ␣ | * | ␣ | ◇ | ␣ | + | ␣ | − | ␣ | × | ␣ | M | ␣ | = | ␣ | ° | ␣ | # | 0 | 1 | 2 | 3 | 4 | 5 | 6 | 7 | 8 | 9 |

FIG. 19
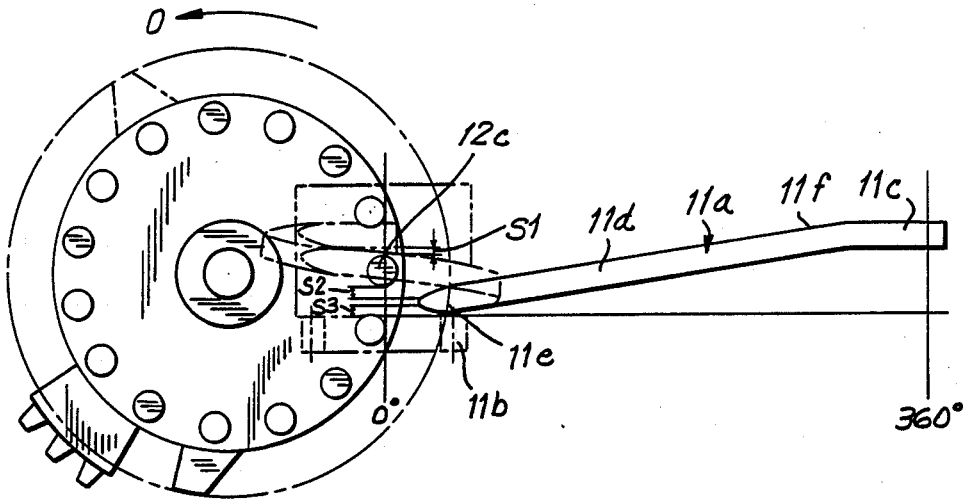
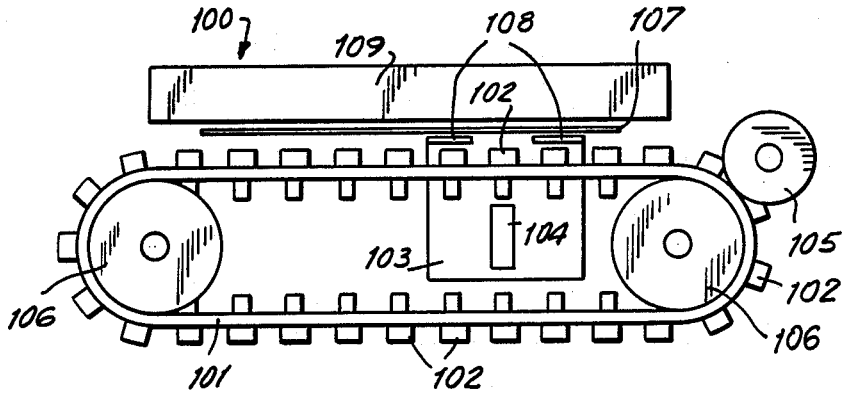
FIG. 25
PRIOR ART

FIG. 21
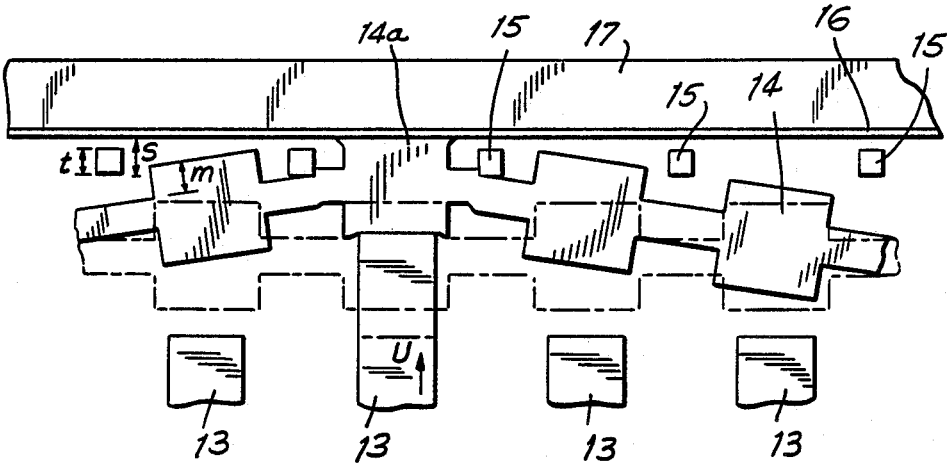
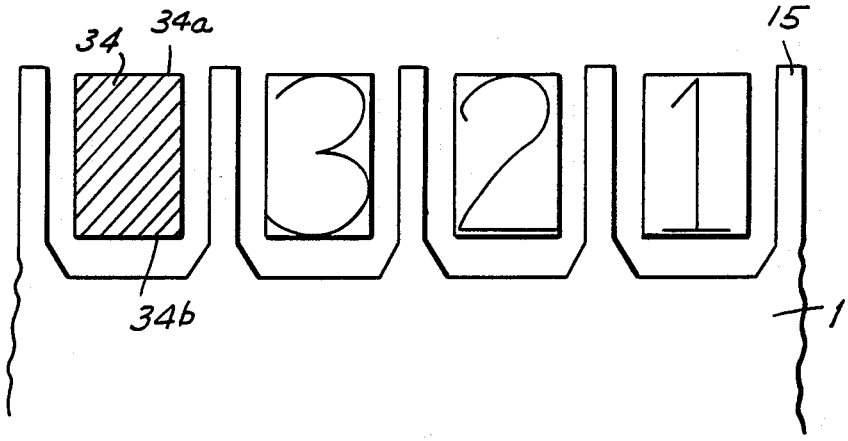
FIG. 20

PRINTER

This is a continuation of application Ser. No. 07/057,088, filed on June 2, 1987, now abandoned.

BACKGROUND OF THE INVENTION

The invention is generally directed to the printing mechanism of a printer and in particular to a printing apparatus for a printer associated with a desktop calculator or an instrument.

In conventional printing mechanisms for serial type printers such the type disclosed in the specification of Japanese Utility Model Laid Open No. 59-122244, an endless belt type carrier (hereinafter referred to as a "type belt") is driven horizontally. A driving cam mechanism and a hammer, which together form a print cam portion and a hammer portion, respectively, for printing a figure, are supported by a hammer holder. The type belt and the cam for urging the hammer against the type belt are controlled by a trigger mechanism including a clutch, an electromagnet and a selection lever. In this type of mechanism, when a desired type element is selected by the trigger mechanism, the type belt is stopped. Then the cam is driven forward, which causes the hammer to be driven, pressing the type against a sheet of paper. After one line of printing is completed the cam portion meshes with a rack supported in the frame to move the printing mechanism to the next column for operation.

When all of the desired figures are printed on a line, the rack is placed out of mesh with the cam portion by a rack removing mechanism and the hammer holder is urged in the direction away from the paper, returning the hammer holder to a home position. The paper feeding is performed in this type of printer by the power produced when the rack is released. Printers of the type described above operate with a type selecting operation, a printing operation and hammer holder return, cam and hammer movement and paper feed operations.

Reference is made to FIG. 25 wherein a printer 100 constructed in accordance with the prior art is depicted. The printer 100 includes an endless belt type carrier 101 with type elements 102 about the outside periphery of belt 101. A head portion 103 including a hammer 104 which is configured to strike the inner surface of endless belt 101 to drive a type element 102 against a sheet of paper 107 supported from behind by a platen 109. The endless belt 101 is driven by a drive gear 105 linked to one of belt support guides 106. A mask 108 provided between the type elements 102 and paper 107 is elastically deformable so that the type elements 102 adjacent to the selected type element 102 do not contact paper 107 when hammer 104 urges the selected type element 102 against paper 107.

In addition, another conventional printer using a type belt is disclosed in the specification of Japanese Utility Model Laid Open No. 59-166954. This printer includes only one space in its symbol type group and printing is achieved by utilizing a carriage with a hammer as described above.

Many types of paper of various widths suitable for use with printers are available on the market. Generally, paper having widths of 38mm and 58mm are conventionally utilized in home desktop calculators and printers utilizing one of these two sizes of papers are generally available. Conventional printers have entirely separate parts, such as paper guides and frame widths prepared for use with a paper of a specific size and thus at least two different printer mechanisms are required to fill the need for printers adapted to take the different widths of paper required in the marketplace.

The prior art endless belt type printers utilize a hammer and a cam mechanism for printing. The cam urges the hammer up into contact with the inside of the endless belt forcing the figure on the type element which is inked to contact the paper thereby printing the figure on the paper. The hammer holder which supports the cam and hammer is moved from column to column and then returned by a mechanism which releases the hammer holder from a rack. As a result, many different parts are required to perform these operations and the overall structure is complicated, making it difficult to manufacture such a printer and resulting in an undesirably high cost of manufacture.

When the conventional printer with an elastic mask, such as mask 108 in FIG. 25, is used, the outside of the type element 102 which is inked, is pressed up against the mask. As a result, the ink is transferred to the mask and then the mask itself is stained with ink. The deformation of the mask by the adjacent type portions on both sides causes the elastic mask to contact the printing paper at the edges. This results in a deterioration in the quality of printing and causes the paper to be stained as the ink leaks around the edges of the mask. In addition, the mask is required to be extremely thin because of the elastic deformation. Thus, the mask can be undesirably deformed during the manufacturing process unless special care is taken which in turn causes the molding of the mask to be expensive and time consuming to attempt to avoid this problem.

In conventional printers a paper guide or frame of the printer is established in accordance with a single paper width. Thus, the printer can only be used with paper of a single width so that there is no interchangeability of paper available.

Accordingly, there is a need for a printer which can be easily constructed with a simple mechanism using fewer parts than the conventional approaches, there is a need for improved printing quality without staining, lower manufacturing costs and mold costs and interchangeability of paper usage by varying a single paper guide in accordance with the width of the paper desired to be used.

SUMMARY OF THE INVENTION

The invention is generally directed to a printer including an endless belt type carrier having a plurality of type portions on a side face. Hammers for each of the printing positions are provided. A print drum with a plurality of projections spaced about the surface of the print drum for sequentially driving each of the hammers is selectively coupled to the hammers. A drive mechanism selectively moves the type carrier or drives the print drum means to drive a selected hammer.

Accordingly, it is an object of the invention to provide an improved printer.

Another object of the invention is to provide an improved endless belt printer wherein there is a separate hammer for each printable position and a single drive mechanism such as a print drum with projections arranged in a helical fashion around the surface of a print drum.

A further object of the invention is to provide an improved endless belt type printer which reduces the number of elements required for the mechanism thereby reducing the cost of manufacture.

Yet another object of the invention is to provide an improved printer which is inexpensive and is manufactured so that the cost of the mold and parts manufactured therein are minimized while achieving high quality printing clarity and avoiding smearing and staining of the paper.

Yet a further object of the invention is to provide an improved printer in which hammers are provided for each print figure and projections are helically provided on a print drum which drives a hammer at each rotation of a predetermined angle whereby the cam mechanism on the hammer holder and the hammer holder return mechanism can be eliminated.

Still another object of the invention is to provide a printer which interchangeably accepts different widths of paper by varying the paper guide dependent upon the width of the paper.

Still other objects and advantages of the invention will in part be obvious and will in part be apparent from the specification.

The invention accordingly comprises the features of construction, combinations of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a cross-sectional view showing the change mechanism portion of the printer of FIG. 1;

FIGS. 6A and 6B are schematic elevational views showing the differential mechanism of the printer constructed in accordance with the invention;

FIGS. 10 and 11 are views similar to FIG. 4, showing the manner in which the paper is fed;

FIG. 13 is a perspective view of the hammer member constructed in accordance with the invention;

FIG. 14 is a perspective view of a print drum constructed in accordance with the invention;

FIG. 16 is a graphical representation of type arrangements used on a type belt in accordance with the invention;

FIG. 19 is a cutaway and enlarged side elevational view of the print drum and a worm, showing a developed or opened up view of the worm thread, in accordance with a preferred embodiment of the invention;

FIG. 20 is a partially cutaway enlarged front elevational view showing the spatial relationship between the comb-shaped teeth and type elements;

FIG. 21 is a partially cutaway enlarged top plan view of a driven type belt element and showing the relaxed type belt element in its stand-by position in dashed and dotted lines;

FIG. 25 is a top plan view of a conventional endless belt type printer.

DETAILED DESCRIPTION OF THE PREFERRED EMBODIMENTS

The printing apparatus constructed in accordance with the invention includes an endless type belt, hammers provided for each separate printable column, a print drum with angled projections, each of which drives a single hammer upon rotation of the print drum through a predetermined angle. The projections are arranged helically on the rounded surface of the print drum. The printer also includes a power changing mechanism for moving the type belt so that the appropriate type element is in front of the appropriate hammer and then rotating the print drum to print the type element. A platen which also serves as a paper guide opposes the hammer across the paper and in connection with the comb-shaped teeth, which prevents smearing, guides the paper. The type elements are arranged in various ways to optimize printing efficiency and speed.

The hammers for printing figures in each of the printable columns are sequentially driven by the rotation of the print drum. The rotation of the print drum a predetermined angle causes one of the projections to drive one of the hammers. Another rotation of the print drum through the predetermined angle causes another hammer to drive a type element against the paper. One full rotation of the print drum prints a type element or space in each column. The printer prints each of the figures serially from lowest to the highest sequentially. In this way, a simplified printer construction with fewer parts and low cost is achieved.

Figure 1:
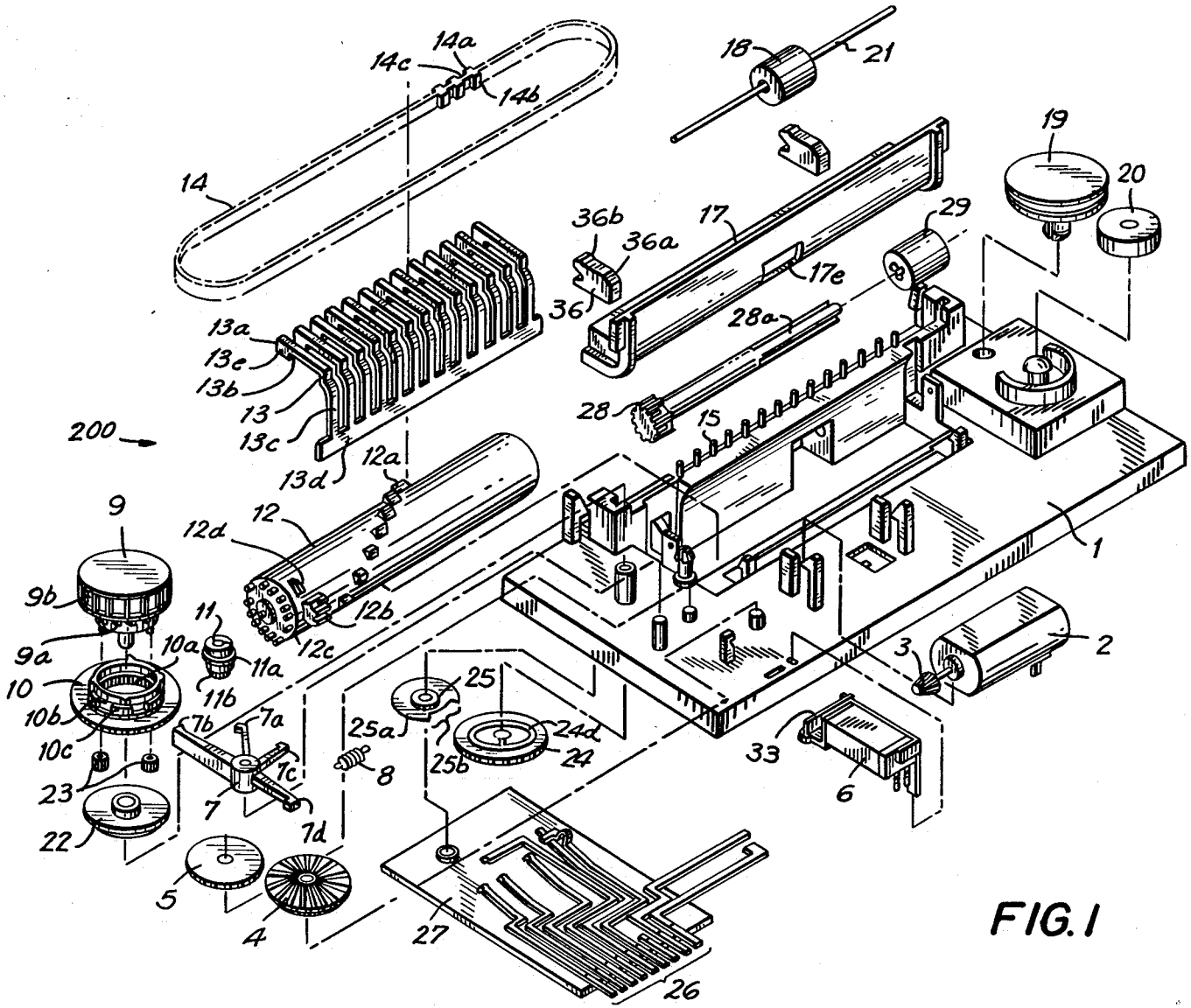
FIG. 1 is an exploded perspective view of a printer constructed in accordance with a preferred embodiment of the invention.
Figure 2:
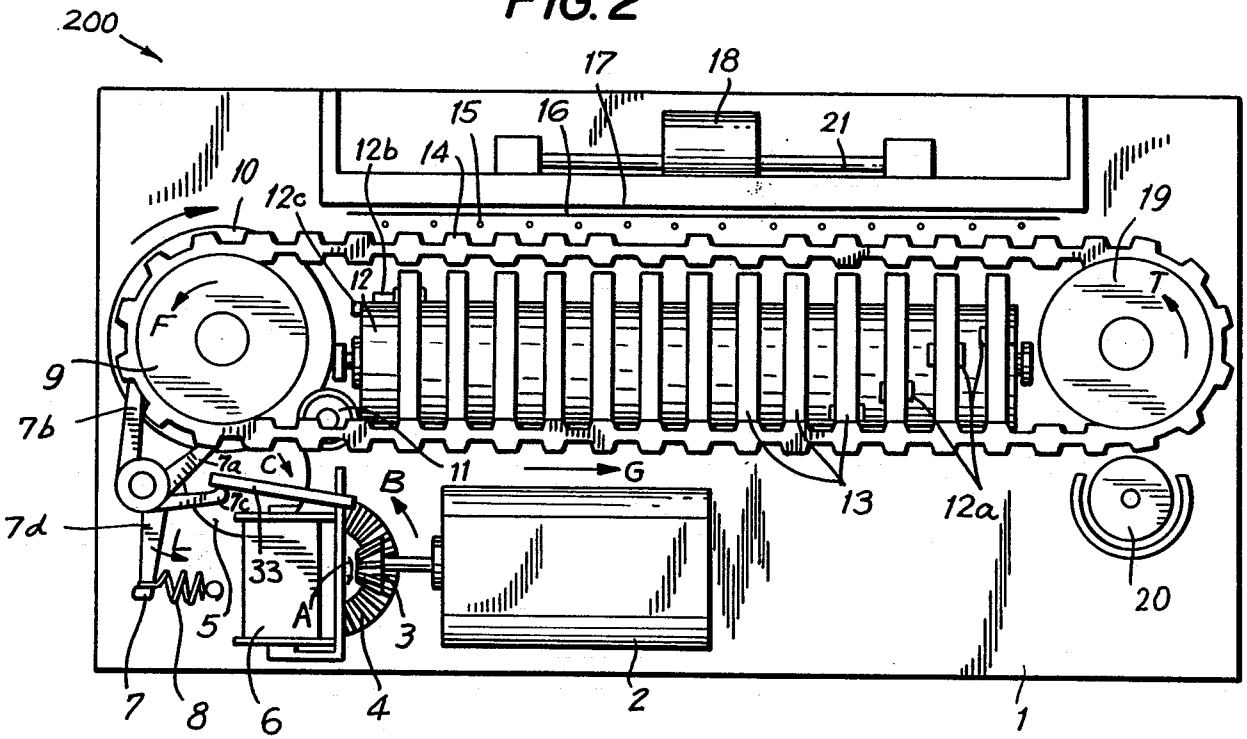
FIG. 2 is a schematic top plan view of the printer of FIG. 1.
Figure 4:
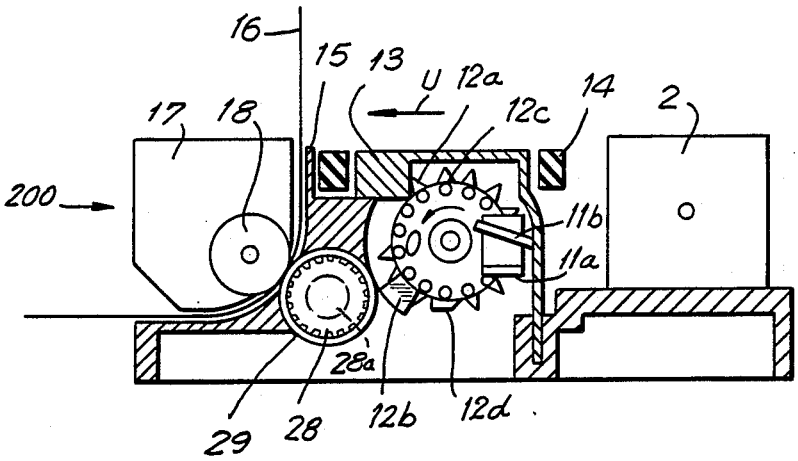
FIG. 4 is a schematic cross-sectional side view of the printer of FIG. 1.

Reference is made to FIGS. 1–4 wherein a printer, generally indicated as 200 constructed in accordance with the invention is depicted. FIG. 1 shows in exploded form the various components of the printer 200. FIG. 2 shows the manner in which the printer elements are assembled. FIG. 3 shows the change mechanism which controls printing. FIG. 4 shows the spatial arrangement of the elements involved in the printing operation.

Printer 200 includes a frame 1 with a motor 2 having a beveled motor gear 3 attached thereto mounted on frame 1. Beveled motor gear 3 meshes with a reduction gear 4 which in turn meshes with a transmission gear 5. An electromagnet 6 having a suction plate 33 contacts selection claw 7. Selection claw 7 is biased by a coil spring 8. One of selection claw arms 7*a* and 7*b* engages with a change gear 10, coupled to the driving pulley 9, or driving pulley 9, respectively. A worm 11, which meshes with change gear 10, drives print drum 12. Hammers 13 are provided between print drum 12 and endless belt 14. A comb-shaped tooth member 15 is located between endless belt 14 and paper 16, which rests against platen 17. Paper 16 is squeezed between press roller 18 and a feed roller 29, mounted on a shaft 28*a* of paper feed gear 28, which feeds the paper. Press roller 18 is supported on a press shaft 21 and extends through opening 17*e* of platen 17. Endless belt 14 is supported around driving pulley 9 and a follower pulley 19. An ink roller 20 supplying ink to type belt 14 is attached to frame 1.

Driving pulley 9 and follower pulley 19 are located so as to leave a predetermined space therebetween with endless type belt 14 wound around pulleys 9 and 19. Follower pulley 19 is rotatably mounted on frame 1. Motor 2 is coupled to change gear 10 through beveled motor gear 3, reduction gear 4 (which is smaller in diameter than transmission gear 5), which in turn meshes with transmission gear 5, which meshes with change gear 10. Selecting claw 7 can selectively engage either driving pulley 9 or change gear 10. When selection claw 7 engages change gear 10 it does not engage with driving pulley 9. Likewise, when it engages with driving pulley 9 it does not engage with change gear 10. Selection claw 7 is rotatably mounted on frame 1 and is urged in the direction of arrow L (FIG. 2) by coil spring 8. In addition, arm 7*c* engages with suction plate 33 of electromagnet 6.

A sun gear 22 meshes with transmission gear 5 and with planet gears 23. Sun gear 22 is rotatably mounted on frame 1. Planet gears 23 are rotatably attached to driving pulley 9. A detector wheel 24 is coupled to driving pulley 9 and meshes with a R detector cam 25 and also presses up against a detector brush 26 made of an electrically conductive material, such as nickel and silver. Detector brush 26 is supported on a support element 27. A circuit including a conductive portion and a non-conductive portion is formed on the surface of detector wheel 24 which contacts with detector brush 26. Projections 12*a* which are adapted to drive hammers 13 and are provided around print drum 12. Print drum 12 is rotated by a worm 11 meshed with change gear 10. Print drum 12 is rotatably mounted on frame 1. A paper feed gear 28 meshes with a feed roller 29 and can be selectively meshed with paper feed driving gear segment 12*b* of print drum 12. Press roller 18 presses feed roller 29 by the load of press shaft 21 which is elastically deformed Ink roller 20, which is attached to frame 1, rotatably presses against the outside of type belt 14, thereby inking the type elements as type belt 14 rotates

Construction of the Type Belt

Figure 15:
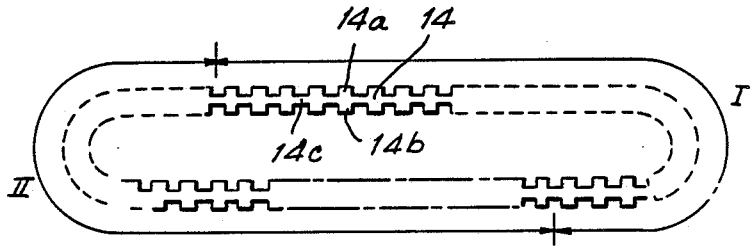
FIG. 15 is a top elevational view of a type belt in accordance with the invention.

Reference is next made to FIGS. 15 and 16 wherein the construction and arrangement of type belt 14 is depicted. As shown in FIG. 15, there are many type portions or type elements 14*a* provided on the outer surface of endless type belt 14 with a predetermined pitch between them in the direction of movement of the belt. In addition, there are many belt teeth portions 14*b* on the inner surface of belt 14 each of which corresponds to one of the type elements 14*a* making a pair, connected to each other by thin connecting portion 14*c*. Type belt 14 is formed from an elastic material such as rubber. The type positions around the circumference of type belt 14 are divided into several groups. There are symbol types such as "+", "−" and others, and figure types, such as "0", "1"... "9"provided in the same group. In a preferred embodiment there are 64 positions on belt 14 (one position corresponding to a single type element) which are divided into two groups, such as group I and group II. Two arrangements of type elements in accordance with the invention, identified as Type A and Type B, are shown in FIG. 16. The Type A grouping includes spaces (shown as "␣") from position 0 to position 10 with symbol type elements from position "11" to position "21" and figure type elements from position 22 to position 31. This configuration has been repeated in group II. In the type element arrangement of Type B, group I includes spaces and symbol type elements provided in alternating positions from position 0 to position 21. Then, the figure type elements are found from position 22 to position 31 with group II having the same arrangement as group I.

Type belt 14 is wound around driving pulley 9 and follower pulley 19. Driving pulley 9 is provided with 16 grooves 9*b* which mesh with belt tooth portions 14*b* and directly drives type belt 14 without slippage on driving pulley 9.

Detection of Timing Pulses

Figure 5:
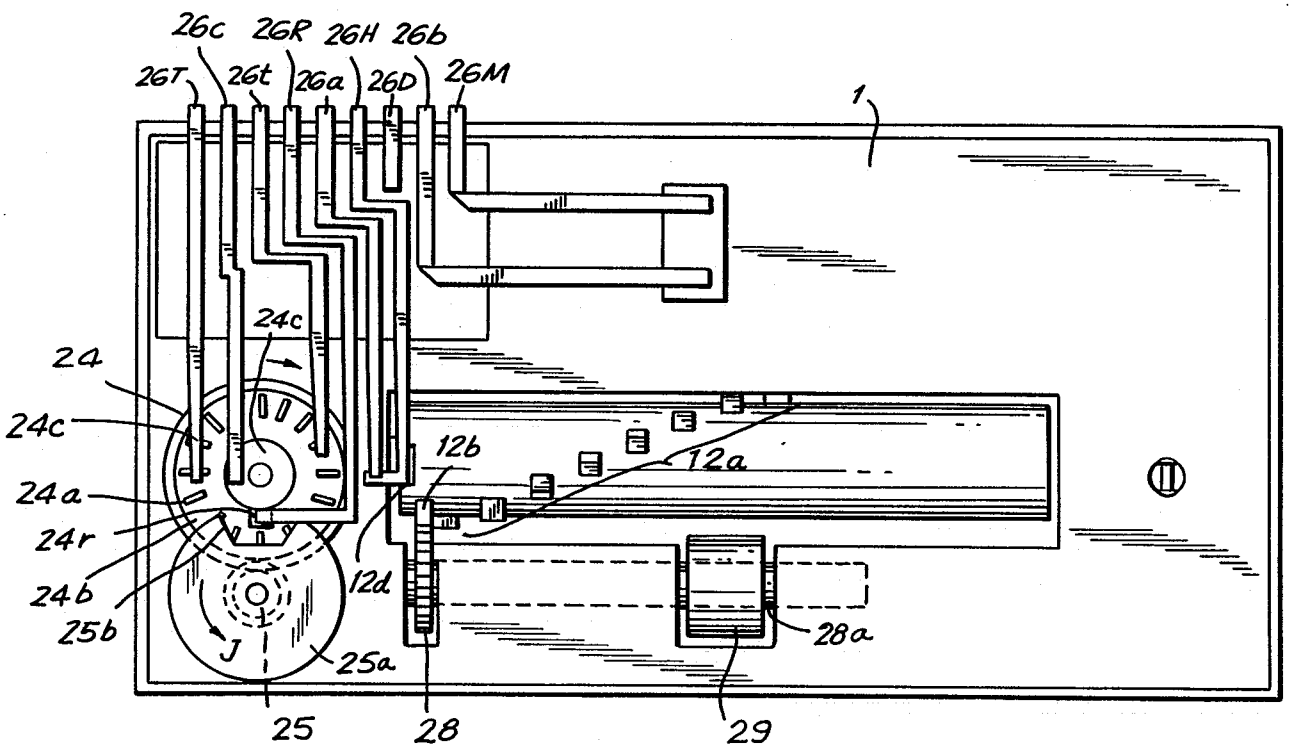
FIG. 5 is a bottom plan view of the printer with various elements removed, constructed in accordance with the invention showing the relationship between a detector wheel and a brush.
Figure 17A:
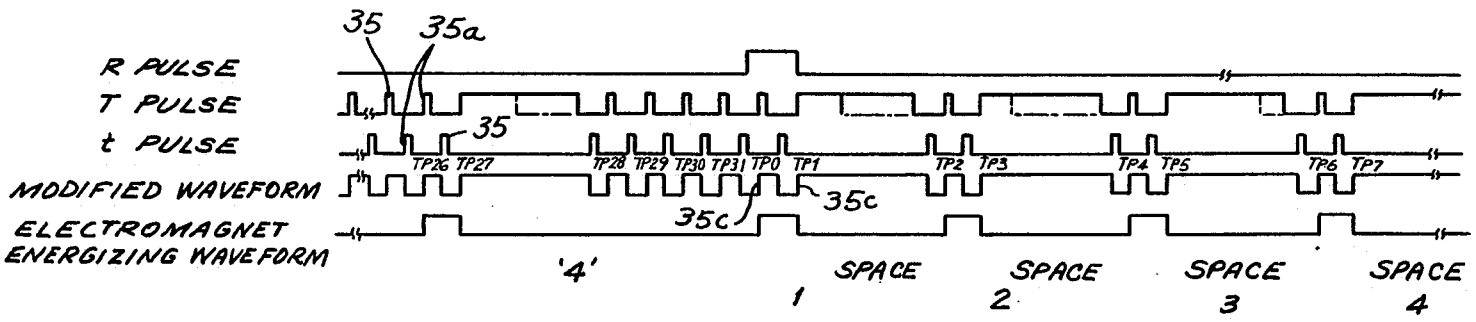
FIGS. 17A, 17B and 18 are timing diagrams showing the relationship between signals in a printer constructed in accordance with a preferred embodiment of the invention.
Figure 17B:
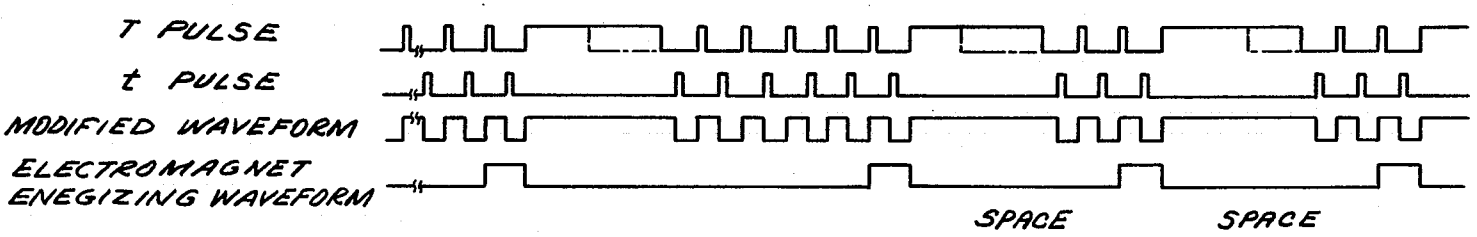

Reference is next made to FIGS. 5, 17A and 17B wherein the operation of the timing pulses detecting mechanism in accordance with the invention is illustrated. Four detector brushes 26 (26T, 26*c*, 26*t* and 26R), made of electrically conductive material, such as nickel silver, are pressed against driving pulley 9 and detector wheel 24 attached thereto. A T brush 26T and a t brush 26*t* are pressed against the location of a TP pattern 24*a* which is a conductive portion on the bottom of detector wheel 24. TP pattern 24*a* includes 16 different radially extending conductive elements corresponding to the 16 grooves 9*b* in driving pulley 9, which corresponds to an integral number of type positions of type belt 14. When T brush 26T presses against TP pattern 24*a*, t brush 26*t* is on a non-conductive portion 24*b*. And when t brush 26*t* presses against TP pattern 24*a*, T brush 26T is on a non-conductive portion 26*b*. An R brush 26R presses on the location of a R pattern 24*r*. Detector wheel 24 meshes with R-detector cam 25. R-detector cam 25 makes two and a half rotations while detector wheel 24 makes one rotation. R-detector cam 25 is made of a non-conductive material and a disk portion 25*a* lies between detector wheel 24 and R brush 26R so as to prevent electrical conduction between R brush 26R and R pattern 24*r*. When detector wheel 24 makes one rotation from the position where R brush 26R contacts R pattern 24*r* as shown in FIG. 5, R-detector cam 25 makes two and a half rotations and R brush 26R is prevented from contacting R pattern 24*a* due to disk portion 25*a*. When detector wheel 24 makes one more rotation, two rotations in total, R-detector cam 25 has made a total of 5 rotations and returns to the position shown in FIG. 5. Then, R brush 26R contacts with R pattern 24*a* through a cutout portion 25*b*. As detector wheel 24 is divided into 16 portions, R brush 26R contacts R pattern 24*r* once in 32 positions ($16\times2=32$). TP pattern 24*a* and R pattern 24*r* are coupled by connectors on the top of detector wheel 24 to a common positive potential area 24*c*. A positive potential which is common between R pattern 24*r* and TP pattern 24*a*, which are connected to common positive potential area 24c by connection pattern 24d (FIG. 1), is provided through common brush 26c.

The detected waveforms of the T pulse and t pulse are likely to cause chattering due to the vibrations of T brush 26T and brush 26t and due to the contact resistance of T brush 26T and t brush 26t with TP pattern 24a. As a result, a method is used where the rising or leading edge 35a of a pulse 35 is recognized as the onset of the waveform pulse which has a rising and falling edge. A modified waveform which rises at the leading edge 35a of the T pulse, which is the potential difference between T brush 26T and common brush 26c, and falls at the leading edge 35a of the t pulse, due to the potential difference between t brush 26t and common brush 26c, is formed in a drive circuit inside the printer and controls the printer thereby. The modified waveform where the R pulse rises is identified as $TP_0$. At $TP_0$,the type position 31 (or type position 63) of type belt 14 is in position for printing at the minimum figure (right most printable position). If this is not the appropriate type element for printing, type belt 14 can be driven around drive pulley 9 and follower pulley 19. A waveform for energizing electromagnet 6 is controlled by the rising edge 35c of a modified waveform and ended by the rising edge 35c of the next modified waveform The highest-speed mode of successive printing in the case of an A type element arrangement on type belt 14 as shown in FIG. 16 is to energize at the leading edge of $TP_0$, deenergize at the leading edge of $TP_1$ and then to again energize and deenergize at the leading edges of $TP_2$ and $TP_3$, respectively. This sequence is shown in FIG. 17A. In this embodiment, the printing operation of a single line is performed from the lowest value digit to the highest value digit (right to left, although printing may be performed in the opposite direction), at which time the paper feeding process can be initiated. Therefore, when a number required to be printed has only seven figures and the printer prints eight figures on each line, a space type element must be selected for the eighth figure to fill the line. In desktop calculators it is rare that a number with the maximum number of figures (for example eight digits) is required to be printed, although there is a need for this capability and high speed printing is desired. As a result, many space type elements are provided on type belt 14 for high speed printing.

When the type elements are arranged on type belt 14 in the B type arrangement shown in FIG. 16, the waveforms in the printing process are shown in FIG. 17B. In this embodiment, when type belt 14, detector wheel 24, drive pulley 9 and follower puller 19 are started and stopped at a high speed, special activity must be taken. In overcoming the inertia and providing an acceleration rate which reaches the maximum value quickly, the required region of the electromagnetic energizing waveform sometimes is narrowed by the spacing of the mechanism such as the backlash of the gears, and a selection error can result. In order to avoid this error one pulse is allowed to pass prior to initiating activity in the highest-speed printing pattern in accordance with the invention.

Type Selection Mechanism

Reference is next made to FIGS. 1, 2, 3, 6A, 6B and 19 wherein the mechanism for selecting a type element is depicted. A frame 1 is formed by injection molding with a resilient force. Motor 2, which is fixed to frame 1, rotates motor gear 3 in the direction of arrow A. Reduction gear 4 is rotated by motor gear 3 in the direction of arrow B and transmission gear 5 is rotated in the direction of arrow C. Sun gear 22 rotates in the direction of arrow D as a result of its meshing with transmission gear 5 and planet gear 23 in turn rotates the direction of arrow E (FIG. 6A).

FIG. 6A shows the differential mechanism where the electromagnet 6 is not energized. Planet gear 23, which rotates in the direction of arrow E, provides the rotational force to change gear 10 so as to rotate change gear 10 in the direction of arrow H by interaction with internal gears 10a. However, claw arm 7a of selection claw 7 engages with an opening 10b on the outside of change gear 10 to prevent the rotation of change gear 10. As a result, planet gears 23 then revolves in the direction of arrow F along internal gear 10b and drive pulley 9 which rotates in the direction of arrow F. As described above, grooves 9b mesh with belt portions 14b of type belt 14 so that the type belt 14 is accurately moved in the direction of arrow G without slipping. Follower pulley 19 functions to reduce the load on the belt, to move type belt 14 smoothly and to keep most of type belt 14 parallel to platen 17. If reduction in cost is a major factor in the printer, follower pulley 19 can be manufactured as a cylindrical part or even a half cylindrical part and formed as part of frame 1 which is formed by injection molding. This further reduces the costs of parts and of assembly.

As described above, when driving pulley 9 rotates and the desired type portion 14a of type belt 14 reaches the desired printing portion the detection of an appropriate pulse through detector T brush 26T, t brush 26t, common brush 26c and R brush 26R, causes an energizing signal to be applied to electromagnet 6.

FIG. 6B shows the differential mechanism wherein electromagnet 6 is energized. When electromagnet 6 is energized, suction plate 33 is provided with a force in the direction of arrow K. Then, actuating arm 7c of selection claw 7 which contacts suction plate 33 is provided with a force in the direction of arrow M. When the force in the direction of arrow M provided by suction plate 33 overcomes the biasing force, in the direction of arrow L by spring 8, selection claw 7 rotates in the direction of arrow M. As a result, claw arm 7b enters the area of rachet 9a of driving pulley 9, locking with rachet end face 9b. This causes the revolution of driving pulley 9 to be stopped. Planet gear 23, which is rotatably attached to drive pulley 9 stops its revolution around sun gear 22 and starts to rotate in the direction of arrow E. At the same time, claw arm 7a moves out of engagement with opening portion 10a of change gear 10 to allow change gear 10 to be rotated. As a result, change gear 10 rotates in the direction of arrow H through the rotational driving force of planet gear 23. Planet gear 23 rotates in the direction of arrow E meshing with internal gear 10a. Claw leg 7a which moves out of engagement with opening 10b presses against an outer peripheral cam portion 10c.

A worm 11 is rotated in the direction of arrow I by gear 11b of worm 11 which engages with gear 10d which is provided on the outer surface of change gear 10. The number of teeth z10 of gear 10d is fixed as an integral multiple of the number of teeth z11 and the number of opening portions 10b around change gear 10 is fixed at z10/z11. In a preferred embodiment, z10 equals 48 and z11 equals 12 so that there are four opening portions 10b. When worm 11 makes one rotation, opening 10b is rotated so that claw arm 7a, which is provided with a force in the direction of arrow L by coil spring 8 so that it presses against the outer periphery portion 10c of change gear 10, engages with opening 10b. As a result, claw arm 7b then moves out of engagement with rachet 9a of driving pulley 9 and suction plate 33 moves in the direction of arrow W. Change gear 10 stops rotating, which causes planet gear 23 to again start revolving in the direction of arrow F and driving pulley 9 rotates in the direction of arrow F. Then, type belt 14 starts to move in order to return to the stand-by condition waiting for an energizing signal to be applied to electromagnet 6.

The Printing Mechanism

Figure 7:
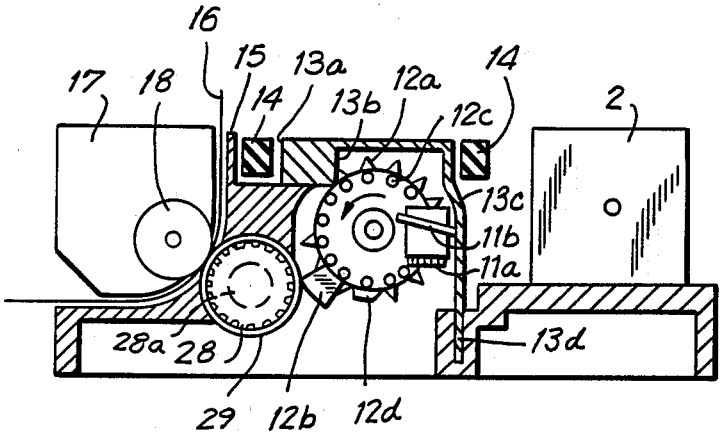
FIGS. 7, 8 and 9 are views similar to FIG. 4, showing the printing operation.
Figure 8:
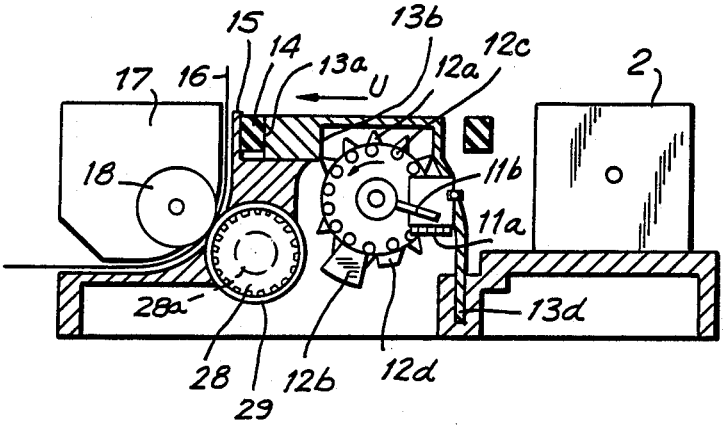
Figure 9:
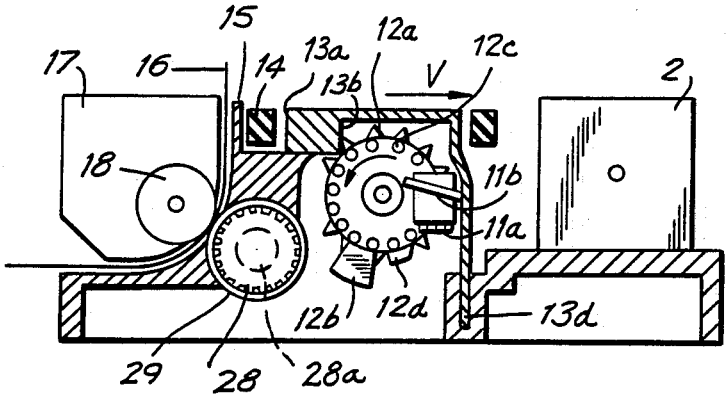
Figure 12A:
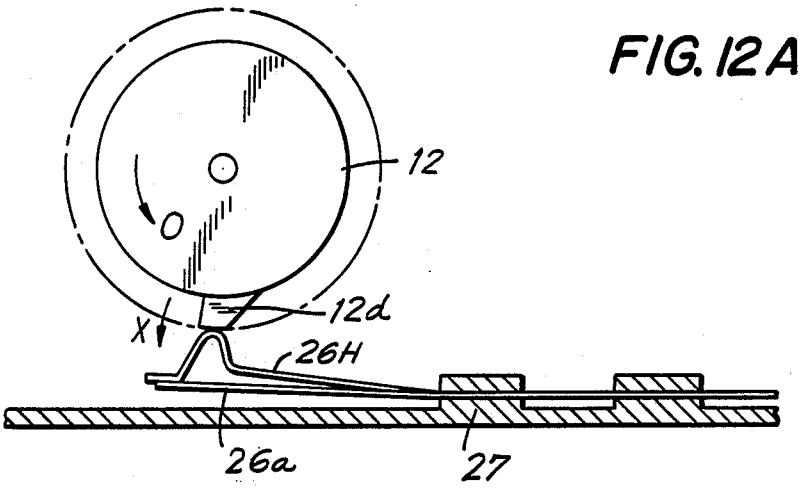
FIGS. 12A and 12B are schematic side elevational views showing the interrelationship of the printing drum and brush and the manner in which the printer achieves a home position.
Figure 12B:
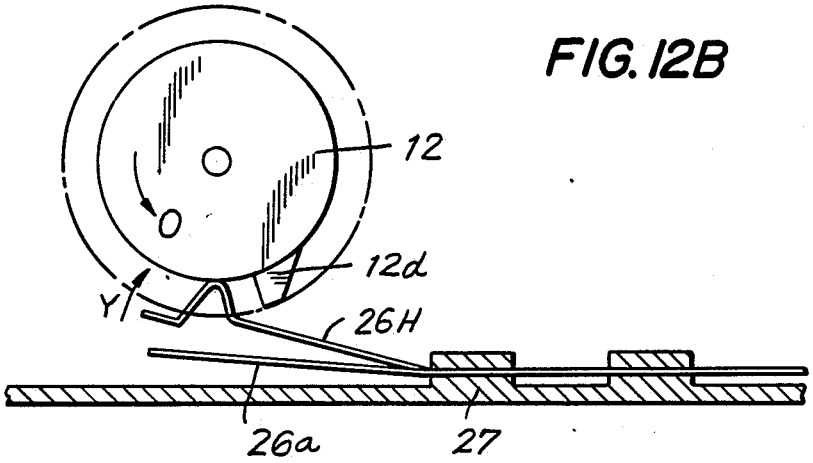

The printing mechanism is described with reference to FIGS. 4, 7, 8, 9, 12A, 12B, 13, 14, 19, 20 and 21 wherein various aspects of the printing mechanism and operation in accordance with the invention are depicted. FIG. 14 is a perspective view of print drum 12 and, FIG. 13 is a perspective view of hammer unit 13. FIG. 7 is a cross-sectional view of the printer shown in a stand-by state prior to the printing of the first figure. FIG. 8 is a similar cross-sectional view during the printing of a first figure and FIG. 9 is the same view in the stand-by position after the first figure has been printed. FIG. 12A shows the position of brush 26 in its home position before the printing of a first figure while FIG. 12B shows the state of the brush after printing a first figure.

As seen clearly in FIG. 13, hammer unit 13 includes pressing portions 13e, elastic portions 13c connecting portions 13d and back surface portions 13b. Hammer 13 is made of a plastic by means of a monolithic molding or can be made so that elastic portions 13c are made of a metal spring material by means of an insert molding procedure. The number of hammer pressing portions 13e corresponds to the number of columns of figures to be printed. Connecting portion 13d connects the hammer portions together and couples hammer unit 13 to frame 1.

A home position cam 12d on print drum 12 pushes down a home position brush 26H which is formed of an elastically deformable conductive material such as nickel silver. Home position brush 26H is deflected downward in the direction of arrow X so that home position brush 26H contacts with common brush 26a, thereby generating a print drum home position signal. The generation of the print drum home position signal confirms that print drum 12 is in the stand-by position for the first figure. Electromagnet 6 is energized when the desired type portion 14a of type belt 14 reaches the position for printing the first figure.

As described above, worm 11 rotates under the rotational force of change gear 10. A worm thread 11a includes a gear tip portion 11e, a circumferential thread portion 11c and helical thread portion 11d. FIG. 19 shows the relationship between worm gear 11a and a pin 12c in the stand-by conditions. The solid lines show a developed or opened up view of worm gear 11a and the chain line is a through-view of worm thread 11a. In the stand-by condition, circumferential thread portion 11c of worm 11a is between pins 12c of print drum 12 to control free rotation of print drum 12. In order to prevent gear tip portion 11e from striking against pin 12c a space S3, between gear tip portion 11e and an upper pin 12c, is larger than a space S1, between circumferential thread portion 11c and a lower pin 12c. Further, a space S3, between gear tip portion 11e and the upper pin 12c, is provided.

When worm 11 rotates, gear tip portion 11e goes proximate to pins 12c before circumferential thread portion 11c moves away from the previous pair of pins. As a result, pins 12c are lifted up by an upper surface 11f of helical thread portion 11d and as a result print drum 12 rotates in the direction of arrow 0. Projections 12a provided around print drum 12 press against the back surface 13b of the pressing portions 13e of hammer unit 13 in the direction of arrow U (FIG. 21). Pressing surface 13a then presses against belt gear portion 14b of type belt 14 which is moved outward so that the type element 14a paired with the pressed belt gear portion 14b is urged against paper 16 leaving a printed impression of paper. As print drum 12 continues rotating in the direction of arrow 0 the back surface 13b of pressing surface 13e moves out of engagement with projections 12a of print drum 12, which slides along the back surface 13b. As a result, hammer pressing portion 13e moves in the direction of arrow V (FIG. 9) as a result of the resilient force of the elastic portion 13c of hammer unit 13 and returns to the stand-by position shown in FIG. 9.

On the other hand, home position cam 12d which elastically deforms home position brush 26H so as to contact common brush 26a also rotates in the direction of arrow 0 so as to cause the disengagement of home position brush 26H and common brush 26a in the direction of arrow Y (FIG. 12B). As a result, the home position signal, which is provided by home position brush 26H and common brush 26a ends during the middle of the first figure of printing as is shown in the timing diagram of FIG. 18.

Next, the printing operation will be described with regard to the printing of the second and subsequent figures up to the last or maximum number figure. When printing of a figure is not required, space type elements are selected from the type positions on type belt 14. FIG. 21 is an enlarged partial view of the printing operation with a type element 14a pressed up against the paper 16. FIGS. 20 and 21 are also partial views showing the spatial relationship between the type elements 14a and the comb-shaped tooth member 15 which replaces the elastic mask (mask 108 of FIG. 25) of the prior art.

A comb-shaped tooth member 15 is provided on frame 1 which serves also as a guide for hammer unit 13 and as a guide to oppose print paper 16. The comb-shaped tooth member 15 is formed by injection molding with frame 1 so that its leg extends from below the lower portion 34b of print region 34 to above the upper end 34a of print region 34. The teeth 15 lie between adjacent print regions 34.

Reference is next made to FIG. 21 wherein the chain line shows the stand-by position of type belt 14. When hammer 13 is pushed outward by the rotation of print drum 12, the hammer 13 moves in the direction of arrow L to press type portion 14a against print paper 16 through type belt tooth portion 14b. The ink is applied on to type portion 14a by an ink roller 20 (FIG. 2) so that ink is transferred on to paper 16. The distance s from comb-shaped tooth member 15 to printing paper 16 is greater than the thickness of type portion 14a so that connecting portion 14c of type belt 14 is deformed by the teeth 15. As a result, the type portions 14a on both sides of the selected type element which is being printed are prevented from coming closer than a predetermined distance from print paper 16. Where the thickness t of the teeth 15 is greater than the thickness m of type elements 14*a* this result is even more effective. In addition, comb teeth 15 do not contact the type elements 14*a* which are in the stand-by position or being displaced. Being spaced to avoid contact with the type elements 14*a* they do not become ink stained like the prior art mask. Thus, the type elements on both sides of the selected type element for printing are prevented from contacting the paper and causing smearing or erroneous printing.

The Paper Feed Mechanism

Figure 18:
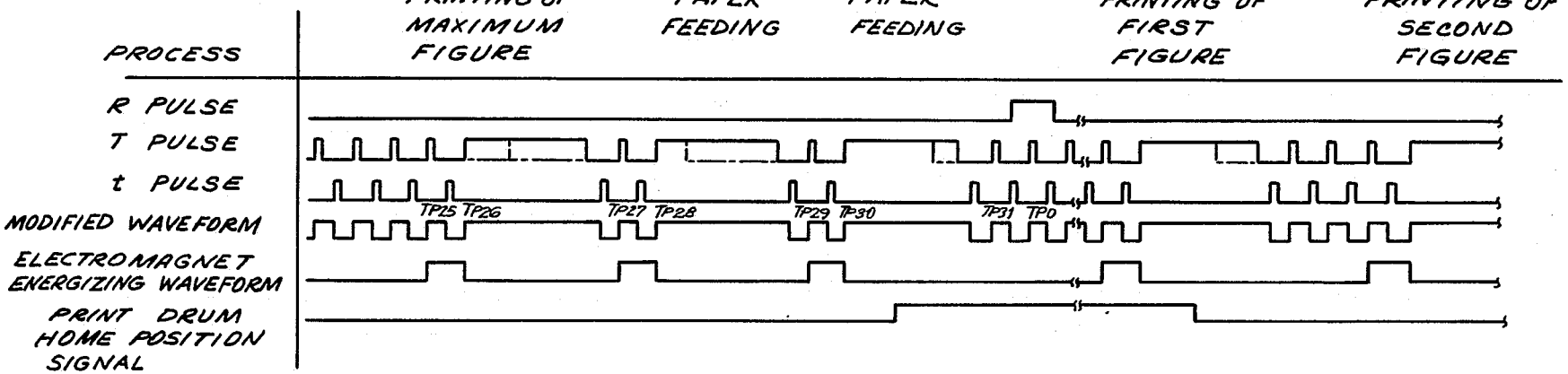

Is described with reference to FIGS. 10, 11, 12A, 12B and 18. FIG. 10 is a cross-sectional view of the printer after it has printed the final number in a column. FIG. 11 is a similar cross-sectional view during the paper feeding process. 13 projecting portions 12*a* are provided around print drum 12. The 13 projecting portions 12*a* correspond to the maximum print figure, that is the number of columns in which a type element or space will be printed on each line. 15 pins 12*c* are provided on the side face of print drum 12 and print drum 12 makes a single complete rotation for each 15 steps by worm 11. During two of the steps paper feeding is carried out. When print drum 12 rotates in the direction of arrow 0 for the last type element to be printed (13th figure), a fan-shaped paper feed drive gear segment 12*b*, provided on the side face of print drum, 12 rotates in the direction of arrow 0 and stops just prior to meshing with paper feed gear 28. After the printing of the last figure (13th figure), pulley 9 rotates for the selection process. Then, when an energizing signal waveform is provided to electromagnet 6, worm 11 rotates and print drum 12 again rotates in the direction of arrow 0. This causes paper feed drive gear 12*b* to also rotate in the direction of arrow 0. None of the hammer pressing portions 13*a* are urged outward toward the paper because none of the portions 12*a* is spaced for such printing action. Paper feed gear 28 rotates in the direction of arrow Q (FIG. 11) as a result of the rotational force received from paper feed drive gear 12*b*. A paper feed roller 29 made of rubber or a soft resin having a larger diameter than the outside diameter of paper feed gear 28 is situated coaxially around paper feed gear shaft 28*a*. Paper feed roller 29 can be made of rubber and other soft resin having a larger diameter than the outside diameter of paper feed gear 28 or may be formed by two-color injection molding (insert molding) coaxially with paper feeding gear shaft 28*a*. Feed roller 29 also rotates in the direction of arrow Q. The printing paper 16 is pressed by press roller 18 against the roller 29 due to an elastic deformation force caused by the deformation of feed roller 29 and press shaft 21. Accordingly, the paper is friction fed in the direction of arrow R. In this embodiment the desired paper feed is based on the pitch which is obtained by two paper feed movements. Other arrangements or gearing can produce different spacing. Therefore, the paper feed movement is performed by again energizing electromagnet 6. Print drum 12 returns to its stand-by position for printing the first figure as shown in FIG. 7 and a single line printing cycle has been completed. Home position cam 12*d* at this stage presses down home position brush 26H in the direction of arrow X so that home position brush 26H contacts with common brush 26*a* again producing the print drum home position signal. FIG. 18 is a timing chart wherein an energizing signal, which is the shortest paper feed signal, is applied to electromagnet 6. If another line of printing is required the printer repeats the movements described above for each successive line. It is never necessary to move the hammers between printing columns or at the end of a line.

The Construction of the Paper Guide

Figure 22B:
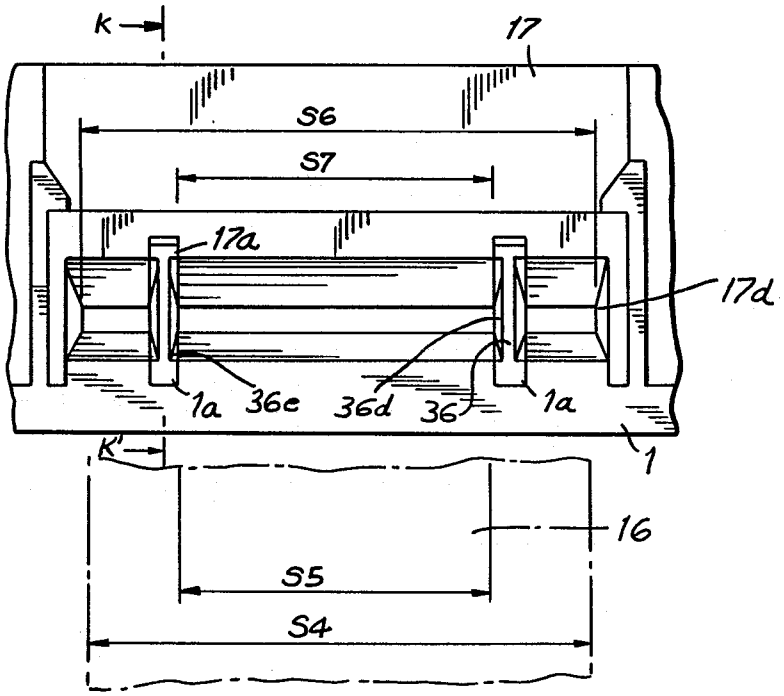
FIGS. 22A and 22B are cutaway cross-sectional and front elevational views, respectively, of a print paper guide portion constructed in accordance with the invention.
Figure 22A:
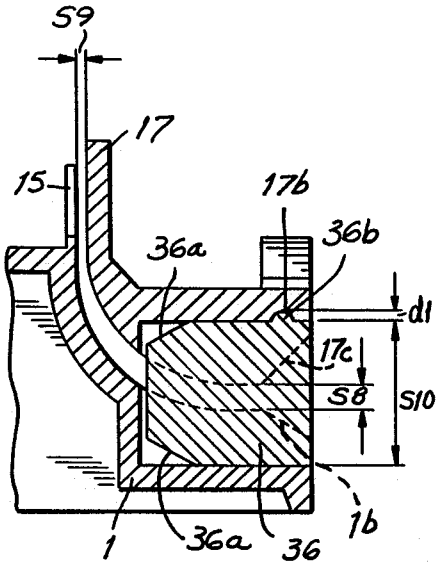

Reference is next made to FIGS. 22A and 22B wherein the feeding portion of the paper guide mechanism through which the printing paper 16 is fed, is depicted. FIG. 22B is an elevational view of the feeding portion for paper 16 and FIG. 22A is a cross-sectional view taken along line K—K'. The guide for paper 16 includes a combination of platen 17, which also serves as a paper guide and a separator 36. Grooves 1*a* and 17*e* are symmetrically located on frame 1 and platen 17, respectively. A depression 17*b* is provided in groove 17*a* of platen 17. Separator 36 can slide along grooves 1*a* and 17*a* and an angled portion 36*a* is provided on separator 36 in order to ease the insertion of separator 36 into grooves 1*a* and 17*a*. In addition, a projection 36*b* engages with depression 17*b* in groove 17*b* of platen 17. Angled portions 36*d* which guide paper 16 are symmetrically provided to form a tapered shape.

Paper of widths S4 and S5 can both be utilized with the same structure dependent upon the manner in which separator 36 is installed. Where the width of paper 16 is S4, the width S6 of frame 1 is larger than the maximum tolerance of width S4 and spaces S8 and S9 are adjusted to have a thickness greater than that of printing paper 16. The feeding portion is formed as a square shaped funnel formed by slope 1*b* of frame 1 and slopes 17*c* and 17*d* of platen 17 so that paper 16 can be easily fed in. In this situation there is no need for separators 36 which are not used.

If the width of the paper to be used is S5, after frame 1 and platen 17 are assembled, separators 36 are inserted along groove 1*a* of frame 1 and groove 17*a* of platen 17 so that the distance S7 is the same as the maximum tolerance of the paper width S5. Then, projections 36*b* of separators 36 are inserted so as to expand the space S10 by length d1 due to elastic deformation of platen 17 and/or frame 1. Finally, projection 36*b* engages with depression 17*b* of platen 17 and spacing S10, which has been extended during installation of separator 36, returns to its original size so that separator 36 is fixed in place and does not easily slip out or slide. Separator 36 is provided with similar sloped surfaces at 36*c* and 36*d* which serve the same function as slopes 17*c* and 17*d* of platen 17. A slope 36*e* on separator 36 serves the same function as slope 1*b* on frame 1. Separators 36 are shaped symmetrically so that it is only necessary to produce a single separator which is usable both as a left and as a right power guide. This cuts down on the cost of manufacture and molding by only requiring one type of part to be molded.

Figure 23:
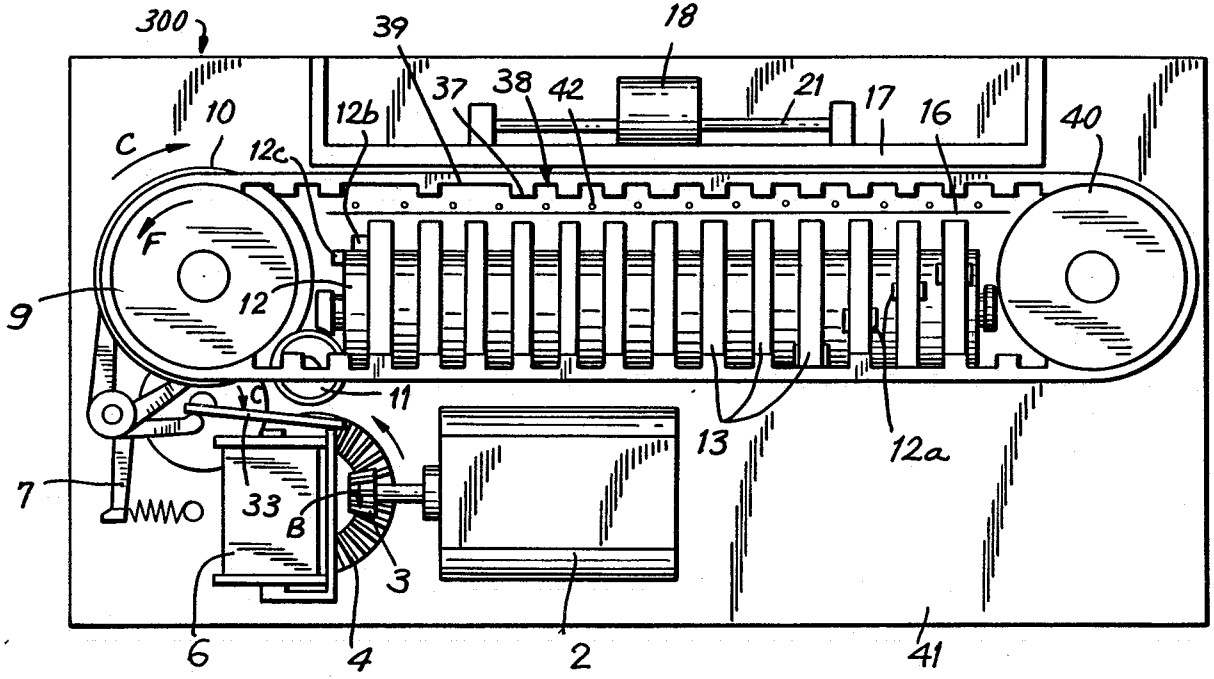
FIG. 23 is a top plan view of a printer constructed in accordance with a second embodiment of the invention.

Reference is next made to FIG. 23 wherein a printer 300 constructed in accordance with another embodiment of the invention is depicted, like elements being represented by like reference numerals. Driving pulley 9 and a follower pulley 40 are spaced apart a predetermined distance and an endless type belt 38 is wound around the two pulleys. The type elements 37 are arranged at a predetermined pitch and in a predetermined order on the inside of type belt 38 made of an elastic member such as rubber. No type elements are arranged on the inside of the belt where spaces are to be printed.

The hammer portion 13 is pressed outwardly by a projection 12*a* of print drum 12 to print a figure. This has the effect of pressing the printing paper 16 up against a type element 37. The printing paper 16 is pressed against type 37 through the spaces between comb-shaped tooth member 42 so that adjacent type elements 37 do not come into contact with the printing paper 16. This prevents the ink staining which is characteristic of the prior art elastic masks.

When spaces are required a space 39 without a type element on type belt 38 is selected. As a result, when claw portion 12 causes a stroke of hammer 13, hammer 13 presses paper 16 but does not contact type belt 38. In the printer of FIG. 23 type belt 38 is constructed so as not to be stretchable, which prevents the need for increasing the strength of the material for operation at low temperatures. In addition, the vibration of type belt 38 is decreased, which insures that type elements 37 do not come into contact with paper 16 at undesirable times and stain the paper.

Figure 24:
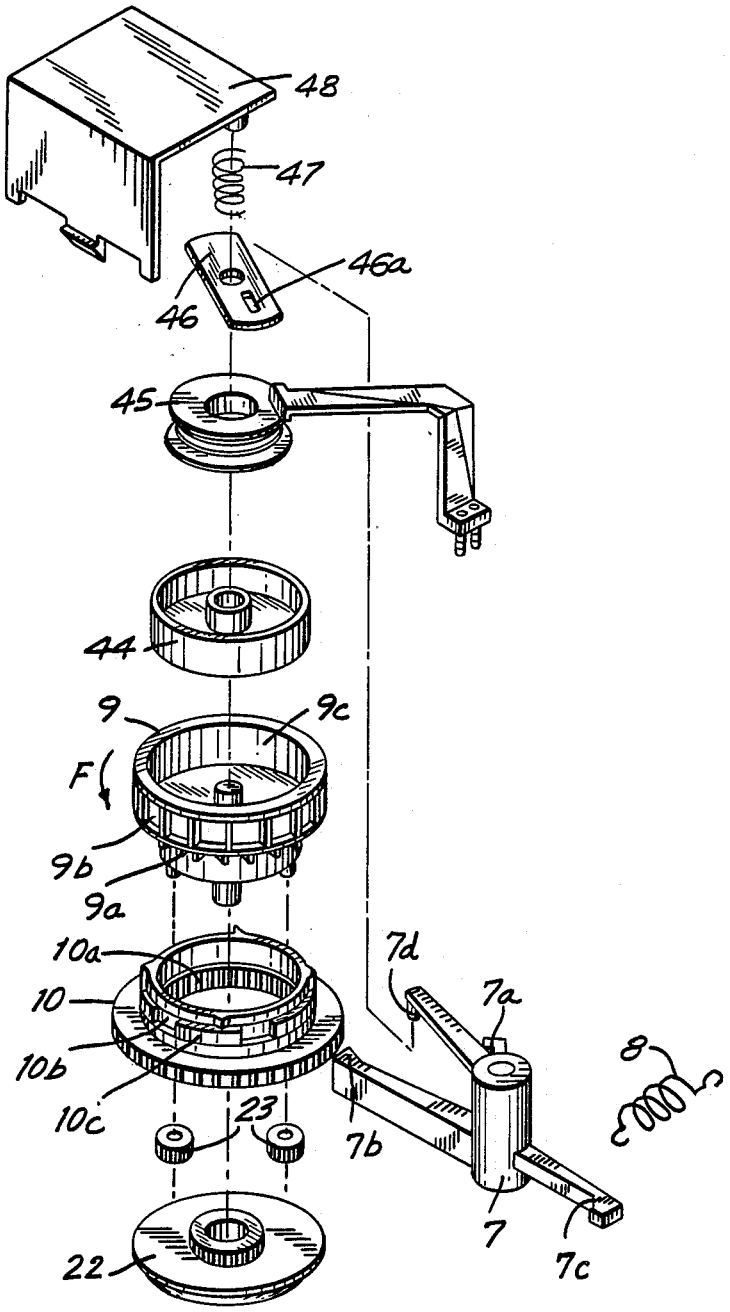
FIG. 24 is an exploded view of a drive mechanism using a lifting plate type electromagnet in accordance with the invention.

In this embodiment, a differential gear mechanism operates as a change mechanism between the type belt feeding movement and the rotation of the print drum. However, the same effect can be achieved by use of a clutch mechanism. The embodiment shown in FIG. 23 utilizes a differential mechanism using a support-type electromagnet as an electromagnet mechanism for changing power from type belt 38 to print drum 12. Reference is made to FIG. 24 where an embodiment utilizing a lifting plate type electromagnet provided on drive pulley 9 including a built-in differential mechanism is depicted. The lifting plate type electromagnet includes a trigger yoke 44 fitted on a depression 9*c* of the upper portion of drive pulley 9. A trigger coil 45 is sized to be rotatably received within trigger yoke 44. A trigger plate 46 has an upper portion thereof urged by a trigger fixing member 48 and a trigger plate spring 47. An operating claw arm 7*d* of claw 7 is inserted into a slot 46*a* of trigger plate 46. A coil spring 8, coupled to claw arm 7*c* creates a biasing force. During the type selecting process, as trigger yoke 44 rotates in the direction of arrow F with driving pulley 9 and trigger 45 attracts trigger plate 46 when energized, trigger yoke 44 moves in the direction of arrow F. Due to this driving force, claw 7 is rotated causing a change in the power being applied from the type belt to the print drum. Therefore, if a lifting plate type electromagnet is used as the electromagnet mechanism the same functioning, operations and effects are achieved.

The printer constructed in accordance with the invention is designed so that with each incremental rotation of the print drum through a predetermined angle, a different hammer from the set of hammers arranged to print all of the figures is driven. This works as a result of the projections being helically arranged on the peripherial surface of the print drum. In this way, a shifting mechanism for advancing a type element into contact with the paper and a hammer holder return function can be eliminated. This aids in the construction of a low cost easy construction printer having a small number of parts.

In addition, a comb-shaped tooth member 42, provided on the paper guide, blocks the forward movement of the connecting portions connecting the type elements on the type belt. As a result, the type elements for non-selected figures do not contact the printed paper, which results in clear printing without ink stains at the sides. Further, the inked type element surfaces do not contact the teeth and smear them with ink. In addition, as the comb-shaped tooth member 42 can be integrally molded with the frame and a paper guide, the cost of the printer can be significantly reduced. In addition, the type belt on both sides of a print position are guided so that paper bulging is prevented and printing noise is reduced. Furthermore, the teeth are provided between each of the printable positions so that they can be used also in connection with a line printer as compared to the serial printer described above.

Further, in accordance with the invention the type belt is arranged so that a space type element group having two or more spaces and a type element group used for printing are provided on a single type belt. Alternatively the space type elements may be alternated with printing type elements for further efficiency. This is particularly true where the figure to be printed does not occupy the entire printing line. Thus, the spaces can be quickly selected so that a low cost printer can achieve high speed printing and the printer is economically valuable. This is particularly so in a printer as disclosed where printing is performed from the lowest column figure to the highest column figure in a serial manner.

The printer in accordance with the present invention can be assembled using paper guides for varying widths of paper. For example, when the printers are manufactured for use with paper having a width of 58mm no separators are utilized. On the other hand, when a printer is to be used with paper having a width of 38mm, separators are manufactured and inserted into grooves in the platen and frame. Both size paper guides can be assembled without duplication of molding or manufacturing expenses or an increased administrative cost for maintaining an inventory of parts. As the printer can be customized to the required size paper in the last assembly process, it is not necessary to maintain an inventory of products for each of the different paper sizes. Thus, further reductions in cost of manufacture and production are achieved. It is thus not necessary to make a paper guide for each paper size and the cost of molds is also reduced because both separators can be identical.

Accordingly, an improved printer which minimizes the number of parts and cost by utilizing a single print drum with helically arranged hammer urging mechanisms, a comb-shaped guide for preventing smearing and staining and use of the basic printer with various widths of paper is achieved. The optimization of the type element locations including the efficient placement of multiple space type elements to increase the speed of selection improves the speed and usefulness of the endless belt type printer.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer for printing on a print medium, comprising:

a type carrier in the form of an endless belt having a plurality of type elements on a side face;

hammer means for urging the type elements and the print medium, comprising:

a type carrier in the form of an endless belt having a plurality of type elements on a side face;

hammer means for urging the type elements and the print medium into contact, said hammer means having a unitary structure extending substantially parallel to a portion of the type carrier and including a hammer member for each printable position of the printer and spring means for resiliently urging the hammer member away from contact with the print medium;

print drum means for selectively driving said hammer means, aid print drum means including a print drum rotatably secured at a fixed distance from aid hammer means with a plurality of projections on the peripheral surface of the print drum, there being a like number of projections and hammer members, each of the projections being adapted to drivingly contact a separate hammer member whereby rotation of the print drum results in the driving contact of the hammer members by the projections; and control means coupled to the type carrier and the print drum means for selectively advancing the endless belt relative to the hammer means and rotating the print drum and including a motor for generating the driving power for advancing the endless belt and rotating the print drum and electromagnet means for effecting the switching between advancing the endless belt and rotating the print drum; whereby selecting printing of the type elements on to the primary medium is performed.

2. The printer of claim 1 wherein the projections are helically arranged about the peripheral surface of the print drum.

3. The printer of claim 2 wherein there is a predetermined circumferential angle between adjacent projections on the periphery of the print drum.

4. The printer of claim 3 wherein the rotation of the print drum by the control means through the predetermined angle causes a hammer member to urge a type element and the print medium into contact with each other.

5. The printer of claim 3 wherein one complete rotation of the print drum drives each of the hammers.

6. The printer of claim 5 wherein one complete rotation of the print drum further causes the print medium to be fed.

7. The printer of claim 1 wherein the print drum means further includes feed means for advancing the printing medium through the printer relative to the hammer means and the type carrier.

8. The printer of claim 7 wherein the peripheral surface of the print drum is divided into a projection portion containing the projections and a feeding portion for driving said feed means to advance the printing medium a desired distance.

9. The printer of claim 1 wherein the control means includes home position means for determining when the print drum is in a home position.

10. The printer of claim 9 wherein the print drum further includes a home position reference member on its peripheral surface and the home position means includes a deformable contact member deformable by the home position reference member to indicate the presence of the print drum in the home reference position.

11. The printer of claim 1 wherein the control means further comprises position detecting means for detecting the position of the type elements on the type carrier relative to the hammer means.

12. The printer of claim 11 wherein the position detecting means includes a detector wheel having a series of conductive patterns radially oriented and circumferentially distributed around the detector wheel and a common pattern electrically coupled to the radially oriented patterns and brush means for selectively electrically coupled to one of the radially oriented conductive patterns.

13. The printer of claim 12 wherein the detector wheel further includes a tape carrier home position conductive pattern electrically coupled to the common conductive pattern, said brush means further including a tape carrier home position brush for selectively contacting the tape carrier home position conductive pattern and a masking member for selectively preventing the electrical contact between the starting position conductive pattern and the starting position brush.

14. The printer of claim 13 wherein the detector wheel has n radially oriented conductive patterns and the mask member allows electrical contact between the tape carrier home position conductive pattern and the home position brush every two complete rotations of the detector wheel to indicate the tape carrier being in a home position.

15. The printer of claim 14 wherein the rotation of the detector wheel from one radially oriented conductive pattern to an adjacent radially oriented conductive pattern is representative of movement of the type carrier from one type element to an adjacent type element.

16. A printer for printing on a print medium, comprising:

a type carrier in the form of an endless belt having a plurality of type elements on a side face;

hammer means for urging the type elements and the print medium into contact, said hammer means having a unitary structure, extending substantially parallel to a portion of the type carrier and including a hammer member for each printable position of the printer and spring means for resiliently urging the hammer member away from contact with the print medium;

print drum means for selectively driving said hammer means, said print drum means including a print drum with a plurality of projections around the peripheral surface of the print drum, there being a like number of projections and hammer members, each of the projections being adapted to drive a separate hammer member and rotation of the print drum resulting in the driving of the hammer members by the projections; and control means coupled to the type carrier and the print drum means for selectively advancing the print drum whereby selective printing of the type elements on to the printing medium is performed; said control means including a motor for generating the driving power for advancing the endless belt and rotating the print drum, electromagnet means for effecting the switching between advancing the endless belt and rotating the print drum, position detecting means for detecting the position of the type elements on the type carrier relative to the hammer means and having a detector wheel which includes a series of conductive patterns radially oriented and circumferentially distributed around the detector wheel and a common pattern electrically coupled to the radially oriented patterns and brush means for selectively electrically coupling to one of the radially oriented conductive patterns;

wherein the print drum further includes a home position reference member on its peripheral surface; said control means further includes home position means for determining when the print drum is in a home position and having a deformable contact member deformable by the home position reference member to indicate the presence of the print drum in the home reference position, said detector wheel further includes a type carrier home position pattern; said brush means further includes a type carrier have position brush for selectively contacting the type carrier home position conductive pattern and a masking member for selectively preventing the electrical contact between the starting position conductive pattern and the starting position brush.

17. The printer of claim 16, wherein the projections are helically arranged about the peripheral surface of the print drum.

18. The printer of claim 17, wherein there is a predetermined circumferential angle between adjacent projections on the periphery of the print drum.

19. The printer of claim 18, wherein the rotation of the print drum by the control means through the predetermined angle causes a hammer member to urge a type element and the print medium into contact with each other.

20. The printer of claim 18, wherein one complete rotation of the print drum drives each of the hammers.

21. The printer of claim 20, wherein one complete rotation of the print drum further causes the print medium to be partially fed through the printer means.

22. The printer of claim 16, wherein the print drum means further includes feed means for advancing the printing medium through the printer relative to the hammer means and the type carrier.

23. The printer of claim 22, wherein the peripheral surface of the print drum is divided into a projection portion containing the projections and a feeding portion for driving said feed means to advance the printing medium a desired distance.

24. The printer of claim 16, wherein the detector wheel has n radially oriented conductive patterns and the mask member allows electrical contact between the tape carrier home position conductive pattern and the home position brush every two complete rotations of the detector wheel to indicate the tape carrier being in a home position.

25. The printer of claim 24, wherein the rotation of the detector wheel from one radially oriented conductive pattern to an adjacent radially oriented conductive pattern is representative of movement of the type carrier from one type element to an adjacent type element.

* * * * *